United States Patent [19]

Holsman

[11] 4,391,074

[45] Jul. 5, 1983

[54] WEEP SCREED

[76] Inventor: Henrietta H. Holsman, 101 Ocean Ave., Apt. B7, Santa Monica, Calif. 90402

[21] Appl. No.: 223,309

[22] Filed: Jan. 8, 1981

[51] Int. Cl.[3] ..... E04B 1/00

[52] U.S. Cl. ..... 52/367; 52/257

[58] Field of Search ..... 52/254–257, 52/452, 454, 671, 676, 364, 367, 371

[56] References Cited

U.S. PATENT DOCUMENTS

| | | | |
|---|---|---|---|
| 658,386 | 9/1900 | Mitchell | 52/257 |
| 1,110,369 | 9/1914 | Bagnall et al. | 52/371 |
| 1,624,121 | 4/1927 | Thiem | 52/255 |
| 3,175,330 | 3/1965 | Holsman | 52/255 |
| 3,345,788 | 10/1967 | Holsman | 52/254 |

*Primary Examiner*—James L. Ridgill, Jr.

*Attorney, Agent, or Firm*—Ellsworth R. Roston; Charles H. Schwartz

[57] ABSTRACT

A weep screed provides reinforcement for stucco at or below the foundation plate line of a building. The weep screed includes a substantially vertical network disposable against the wall of the building before the addition of stucco to the building. The substantially vertical lattice network includes overlapping wires for receiving and reinforcing the stucco and includes line wires extending across the overlapping wires. Another lattice network is extendable from the wall of the building in transvese relationship to the substantially vertical lattice network before the addition of stucco to the building. The transverse lattice network includes overlapping and line wires. The transverse lattice network includes overlapping wires extending to the first lattice network to provide a continuation between the substantially vertical and transverse lattice networks. A further lattice network may be extendable from the transverse lattice network in transverse relationship to the transverse lattice network before the addition of stucco to the building. The further lattice network may include overlapping and line wires. The further lattice network may include overlapping wires extending to the transverse lattice network to provide a continuation between the transverse and further lattice networks. The overlapping wires in the substantially vertical, transverse and further lattice networks are preferably joined to one another at the overlapping positions and are preferably joined to the line wires at the positions where the line wires cross the overlapping wires. The line wires in particular ones of the lattice networks may be disposed relatively close together to provide an enhanced reinforcement of the stucco.

34 Claims, 10 Drawing Figures

WEEP SCREED

This invention relates to a weep screed providing a reinforcement for stucco at or below the foundation plate line of a building. The invention particularly relates to a weep screed or foundation screed which can be attached easily to the walls of a building and which facilitates water drainage and the retention of stucco against the exterior walls of the building.

In the construction of a building, a foundation is first provided. Wooden or metal studs are the extended upwardly to provide support for the walls and roof of the building and to define the outline of the building. A layer of treated paper is then disposed against the wooden studs and a metal or wire mesh is disposed over the paper. Stucco is then applied to the wire mesh to form the exterior walls of the building.

To facilitate the proper disposition of the stucco on the walls of the building, weep screeds have been disposed at or below the foundation plate line of the building. The weep screeds have been formed from a solid sheet of metal. This has caused the weep screeds to be heavy and expensive. It has also produced difficulties in attaching the weep screed to the wooden or metal sill and in providing a bond between the stucco and the metal sheet. It has also inhibited a true weeping of water from the stucco walls of the building.

As will be appreciated, the construction of buildings has constituted a primary industry for centuries. In each generation, considerable efforts have been made to improve construction techniques. In spite of such extensive effort, the construction and use of weep screeds are antiquated and fail to provide the desired advantages.

This invention provides weep screeds which overcome the disadvantages specified above. They are light weight and are easy to manufacture and to attach to the walls of a building. The weep screeds of this invention provide a firm bond for the stucco on the walls. This facilitates a retention of the stucco in position even if the weep screeds should rust after a period of time. The weep screeds of this invention also provide for water drainage and inhibit nesting of spiders and other insects and bugs.

Figure 1:
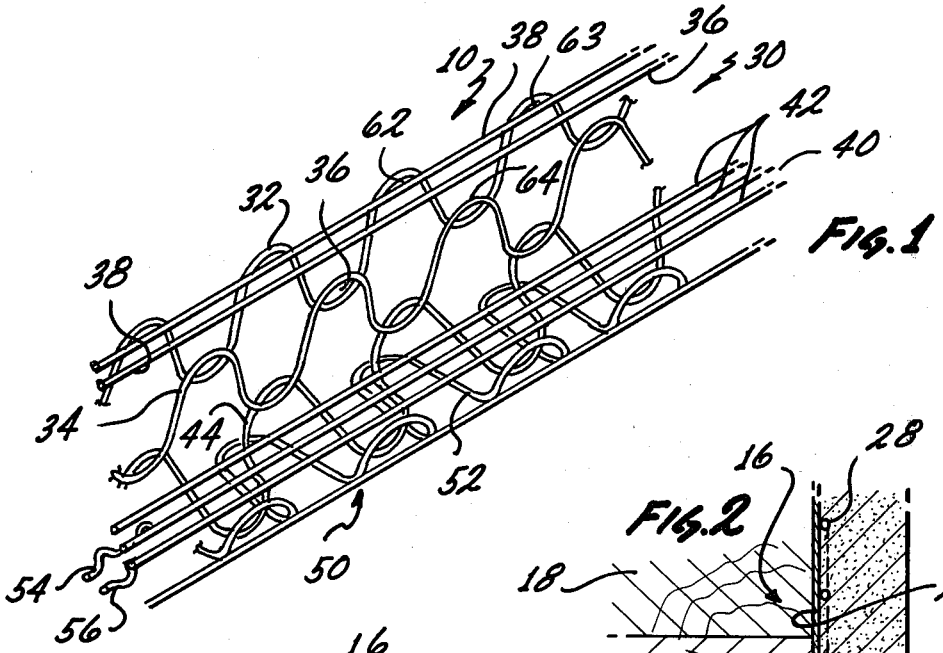
FIG. 1 is a fragmentary perspective view of a weep screed constituting one embodiment of the invention.

In a preferred embodiment of the invention, such as shown in FIGS. 1 through 4, a weep screed, generally indicated at 10, is adapted to be disposed at or below the foundation plate line of a building, generally indicated at 12, to provide a reinforcement for stucco 14 applied to the exterior walls 16 of the building. The walls 16 include wooden studs 18 which provide support for the walls and for a roof. A layer 26 of a treated paper is disposed against the studs 18 and wire or screen netting 28 may be disposed against the layer 26 of treated paper. The layer 26 of treated paper may be disposed interior to, or exterior of, the screen netting 28.

The weep screed 10 is formed from wiring defining lattice networks. For example, in the embodiment shown in FIGS. 1 through 4, a lattice network generally indicated at 30 is adapted to be disposed against the walls 16 at the bottom of the walls. The lattice network is adapted to be disposed against the walls 16 at a position either exterior or interior to the paper 26 and netting 28 and is adapted to be supported by the studs 18. The lattice network may be attached to the studs 18 as by fasteners, nails or staples 31 which extend into the studs 18.

The lattice network 30 is defined by a pair of wires 32 and 34 having an undulating disposition. The undulations have a suitable amplitude peak-to-peak of approximately one inch (1") and have a suitable configuration such as a sinusoidal configuration. The distance between successive waves of the undulations may be in the order of approximately one inch (1") to two inches (2"). As with all of the other wires forming the embodiment shown in FIGS. 1 through 4, the wires 32 and 34 may have a suitable gauge such as a gauge of approximately 0.055 to 0.040. The wires 32 and 34 overlap as at 36 and are joined as by welding or soldering at the positions of overlap. Line wires 38 extend laterally or horizontally across the lattice network 30 at vertically spaced positions. The line wires 38 intersect the undulating wires 32 and 34 and are bonded as by welding or soldering to the wires 32 and 34 at the positions of intersection.

Figure 2:
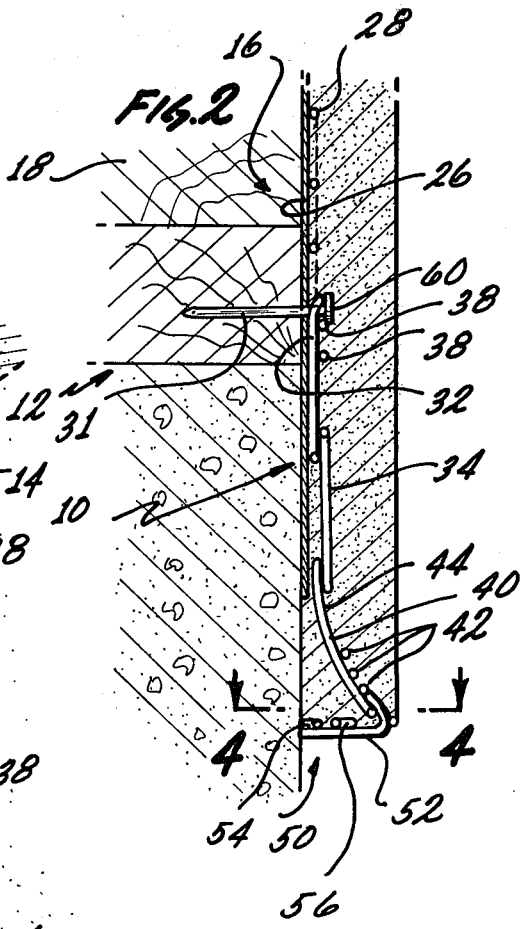
FIG. 2 is a fragmentary elevational view, in section, of the weep screed shown in FIG. 1 when the weep screed is attached to the walls of a building and is reinforcing stucco on the walls of the building.
Figure 3:
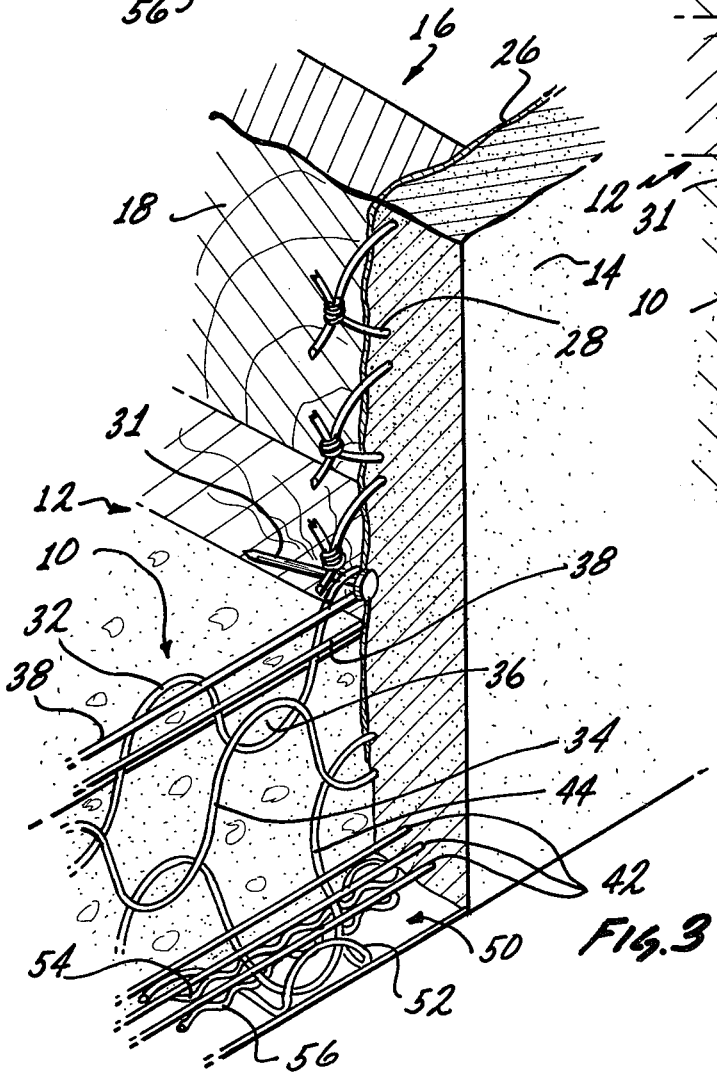
FIG. 3 is an enlarged perspective view of the weep screed of FIGS. 1 and 2 with the weep screed attached to the walls of the building and reinforcing stucco on such walls.
Figure 4:
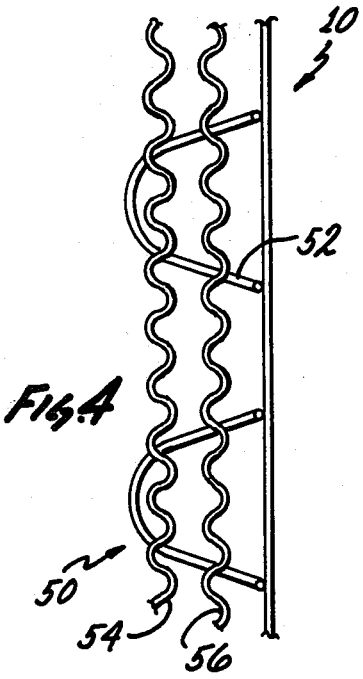
FIG. 4 is a sectional view substantially on the line 4—4 of FIG. 2 and shows the bottom portion of the weep screed.

Preferably, the lattice network 30 is progressively bent toward the horizontal, as illustrated at 40 in FIGS. 1 and 2, at positions approaching the bottom of the lattice network. The progressively bent portion 40 of the lattice network 30 includes line wires 42 extending laterally in intersecting relationship with an undulating wire 44 and joined to the wire 44 at the positions of intersection. The wires 42 are preferably disposed relatively close together to provide enhanced reinforcement for the stucco 14.

The embodiment shown in FIG. 1 includes another lattice network generally indicated at 50. The lattice network 50 extends in an essentially horizontal direction toward the walls 16 of the building. The lattice network 50 may be provided with a suitable depth such as approximately three quarters of an inch (¾"). Although the lattice network 50 extends essentially horizontally toward the walls 16 of the building, it defines an angle different from a perpendicular relationship with the bottom portion 40 of the lattice network 30.

The lattice network 50 includes an undulating wire 52 which is constructed in a manner similar to the wires 32 and 34. The wire 52 may be bent upwardly to overlap the wire 44 and may be joined to the wire 44 as by welding or soldering at the overlapped positions. A pair of line wires 54 and 56 having a slightly serpentine configuration extend laterally across the undulating wire 52. The wires 54 and 56 may be joined to the wire 52 as by welding or soldering at their positions of abutment. The wires 54 and 56 may be provided with a serpentine configuration of a relatively short peak-to-peak amplitude such as one eighth inch ($\frac{1}{8}''$) to one quarter inc ($\frac{1}{4}''$) to impart enhanced reinforcement for the stucco.

The weep screed 10 may be attached to the studs 18 by extending staples or fasteners 60 through the weep screed at suitable positions such as positions 62 or 63 between looped areas 64 defining overlaps of pairs of undulating wires or overlaps of undulating and line wires. The nails 60 may then be driven into the studs 18 to attach the weep screed 10 to the walls 16 of the building. Stucco 14 is then applied to the walls of the building. The stucco may be applied to successive layers through a total thickness at least equal to the depth of the lattice network 50. For example, when the lattice network 50 has a depth of three quarters inch ($\frac{3}{4}''$), the stucco may be applied in a depth of approximately seven dights inch ($\frac{7}{8}''$).

The weep screed 10 has certain advantages over the prior art. Since it has an open construction, it can be easily positioned visually for effective attachment to the walls 16 of the building. Furthermore, the nails or staples 60 can be positioned to be driven into the studs 18 without hunting blindly for the proper position as in the prior art. The open construction of the weep screed also causes it to be relatively light and easily handled.

The weep screed 10 also has other advantages. Because of its lattice construction, the weep screed 10 provides for the stucco 14 to become bonded and prevents the stucco from becoming displaced. This bonding is particularly pronounced since the stucco wraps around each wire and especially the overlapped positions between the undulating wires, such as the positions for the nails 60, and bonds to itself. This bonding is particularly important as the stucco is dried. The weep screed binds the stucco even though it is relatively light and involves a minimal use of material.

Since the weep screed 10 has an open configuration, it facilitates drainage of water. In this sense, the weep screed provides a true weep, in contrast to the weep screeds of the prior art. Because the wiring of the weep screed is made from a suitable metal such as an iron or steel, preferably galvanized, it may rust over a period of time. However, the stucco 14 is not affected since the stucco has substantially a solid mass because of the small size of the wiring in the weep screed and the large spacing between the different wires.

There are other advantages of some importance in the weep screed of this invention. Spiders, bugs and insects cannot nest easily in the weep screed, primarily because of the open construction of the weep screed. In the weep screeds of the prior art, spiders, bugs and insects are able to nest easily in the weep screed. Furthermore, no painting of the weep screed of this invention is required.

The weep screed also has other advantages of some importance. For example, because of its pliability, the weep screed can be tailored to any shape. This can be accomplished by placing the weep screed against the walls 16 of the building and then attaching the weep screed to the walls at progressive positions. In this way, the weep screed can be adapted to indentations and protrusions in the cement foundation.

The configuration of the embodiment shown in FIG. 1 also offers certain advantages. The progressive bending of the bottom portion 40 of the lattice network 30 provides a distribution of forces between the vertical and the horizontal. The acute angle between the bottom portion 40 of the lattice network 30 and the lattice network 50 also helps to destribute forces between the vertical and horizontal. Such distribution of forces tends to facilitate the retention of the stucco 14 in proper position relative to the weep screed and to insure reinforcement of the stucco. The distribution of forces is also facilitated by the disposition of the undulating wire 52 in the lattice network 50 and the extension of this wire into the lattice network 30 and is also facilitated by the inclusion of the serpentine wires 54 and 56.

The positioning of individual wires also tends to impart strength to the weep screed 10 in holding the stucco 14 in proper position. For example, the close positioning of the wires 54 and 56 tends to impart strength to the lattice network 50 and to the stucco, as do the serpentine configurations of these wires. The close spacing of the wires 42 also tends to impart strength to the bottom portion 40 of the lattice network 30.

Figure 6:
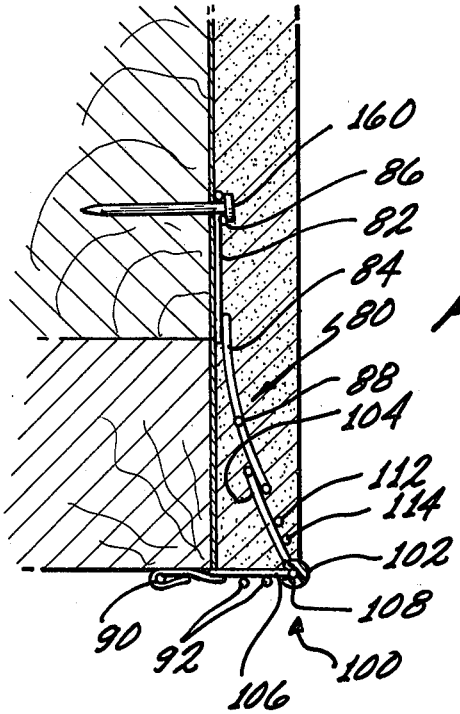
FIG. 6 is a fragmentary elevational view, in section, of the weep screed of FIG. 5 when the weep screed is attached to the walls of a building and is retaining stucco on the walls of the building.
Figure 5:
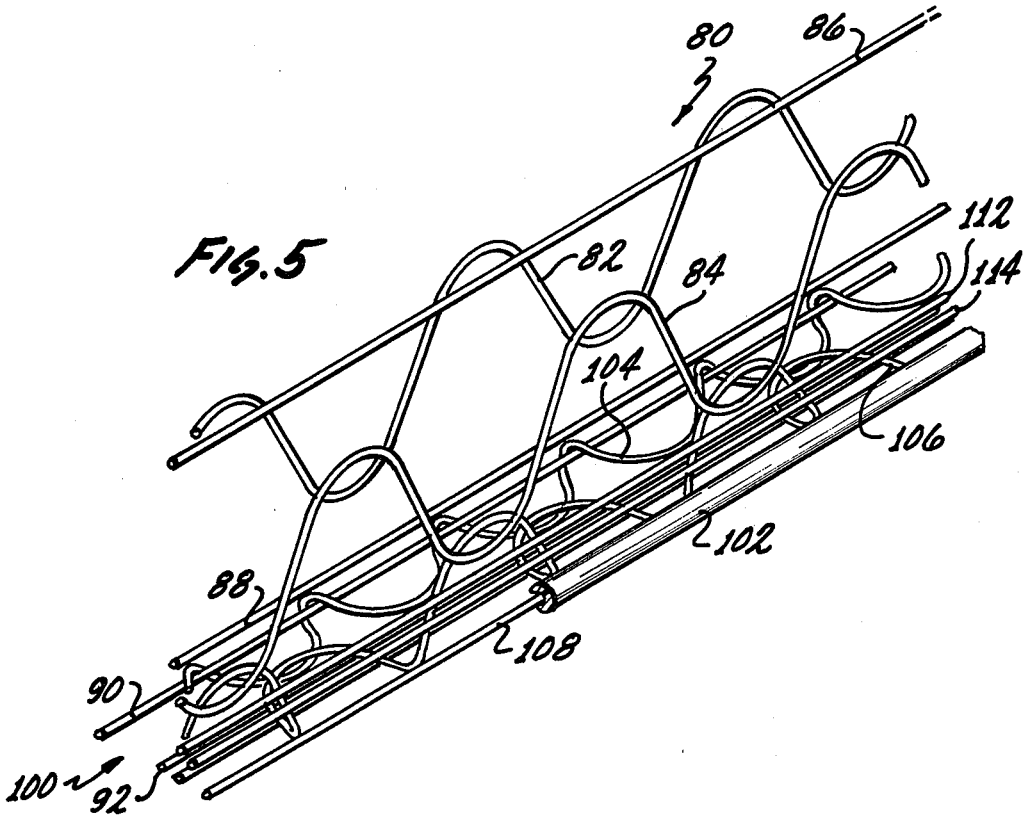
FIG. 5 is a fragmentary perspective view of a weep screed constituting a second embodiment of the invention.

FIGS. 5 and 6 illustrate a second embodiment of the invention. This embodiment includes a lattice network 80 similar to the lattice networks 30 and 40. The lattice network 80 is formed from undulating wires 82 and 84 having an overlapping disposition. Line wires 86 and 88 extend laterally across the wires 82 and 84.

The embodiment of FIGS. 5 and 6 also includes a lattice network 100 which preferably extends upwardly at an acute angle from the lattice network 80. A plastic bead 102 may be disposed at the apex between the lattice networks 80 and 100, this apex preferably being sharply defined. The bead 102 is advantageous because it does not rust. Thus, the bead 102 may be left exposed without any deleterious effects. This is particularly important when the building 12 is near salt water.

The lattice network 100 may include an undulating wire 104, a portion of which extends backwardly and upwardly into the lattice network 80. The lattice network 100 may also include another undulating wire 106 which may be bent under a line wire 108 at the outer extremity of the network and then returned into the network to overlap the wires 84 and 104. In addition to the undulating wire 104, wires 112 and 114 may be extended laterally across the undulating wire 106 at a position near the bead 102. The wires 112 and 114 may be disposed relatively close together to impart enhanced reinforcement to the lattice network 100.

The embodiment of FIGS. 5 and 6 has substantially all of the advantages specified above for the embodiment shown in FIGS. 1 through 4. In addition, the embodiment shown in FIGS. 5 and 6 includes the advantages resulting from the use of the bead 102.

Figure 7:
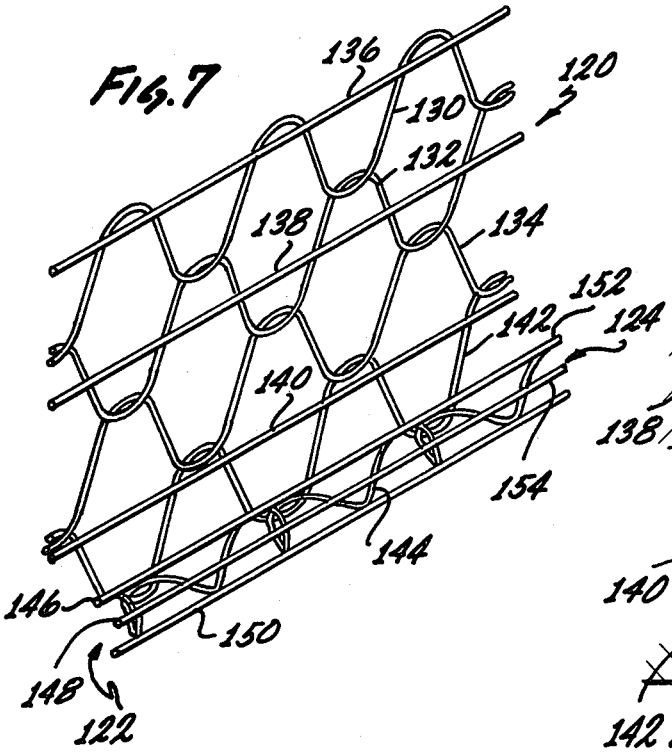
FIG. 7 is a fragmentary perspective view of a weep screed constituting a third embodiment of the invention.
Figure 8:
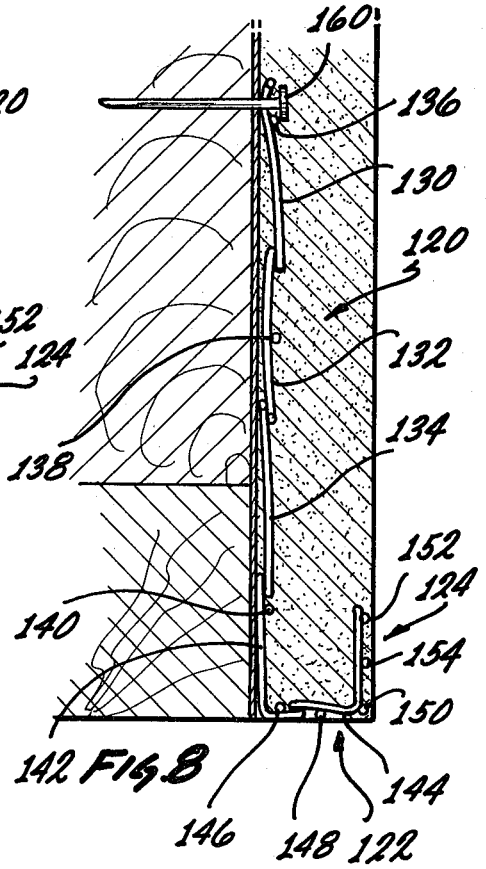
FIG. 8 is a fragmentary elevational view, in section, of the weep screed of FIG. 7 when the weep screed is attached to the walls of a building and is reinforcing stucco on the walls of the building.

The embodiment shown in FIGS. 7 and 8 also has a number of the same advantages as the embodiment of FIGS. 1 through 4 and the embodiment of FIGS. 5 and 6. It includes lattice networks generally indicated at 120, 122 and 124. The lattice networks 120 and 124 are substantially vertical and the lattice network 122 is substantially horizontal. Transitions may be respectively provided between the networks 120 and 122 and between the networks 122 and 124.

The lattice network 120 may include undulating wires 130, 132, and 134 and line wires 136, 138 and 140 disposed relative to one another in a manner similar to that described above. An undulating wire 142 may be disposed partially at the bottom of the network 120 and may be bent to extend into the lattice network 122. Similarly, an undulating wire 144 may be disposed partially in the network 122 and may be bent to extend into the lattice network 124.

Line wires 146, 148 and 150 may be provided in the network 122 and may be extended laterally across the wires 140 and 142. The wires 146, 148 and 150 may be provided with a relativey close spacing. Similarly, line wires 152 and 154 may be provided in the network 124 and may be extended laterally across the wire 144. The wires 152 and 154 may also be provided with a relatively close spacing.

The embodiment shown in FIGS. 7 and 8 differs from the embodiment shown in FIGS. 1 through 4 in that it provides a flat surface for holding the plaster. It also includes an additional lattice network 124 which extends upwardly, at a position near the exposed surface of the stucco, from the flat surface defined by the lattice network 122. The lattice network 124 facilitates the retention and reinforcement of the stucco 16 in proper position relative to the walls 16 of the building.

Figure 9:
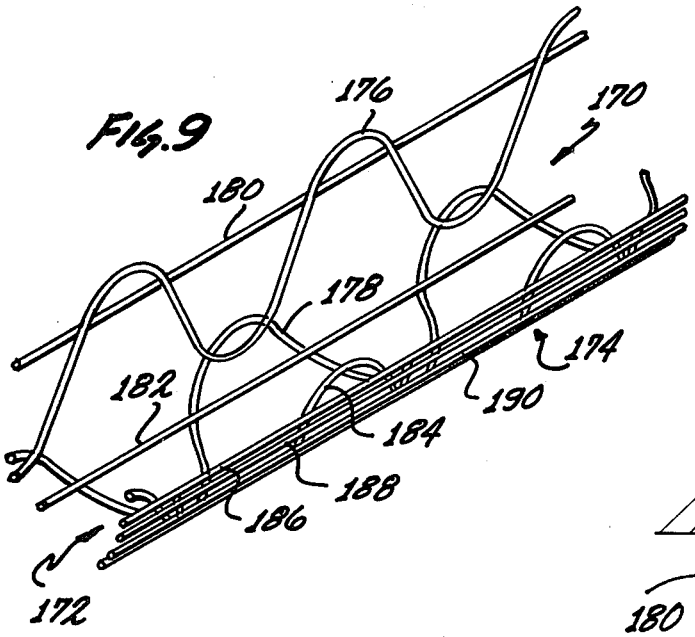
FIG. 9 is a fragmentary perspective view of a weep screed constituting a fourth embodiment of the invention.
Figure 10:
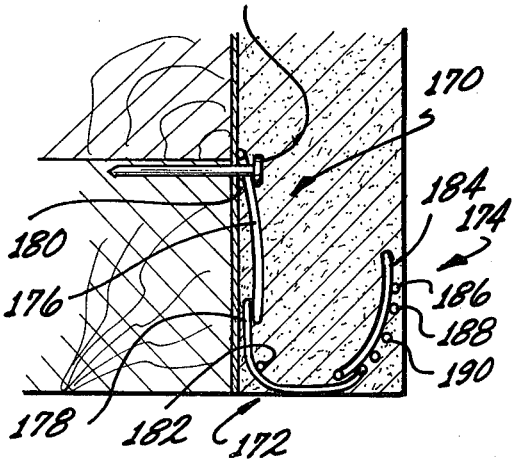
FIG. 10 is a fragmentary elevational view, in section, of the weep screed in FIG. 9 when the weep screed is attached to the walls of a building and is reinforcing stucco on the walls of the building.

The embodiment of FIGS. 9 and 10 is somewhat similar to the embodiment of FIGS. 7 and 8. It includes lattice networks 170, 172 and 174, the lattice networks 170 and 174 being vertical and the lattice network 172 being substantially rounded from the lattice networks 170 and 174 to define a horizontal portion. The lattice network 170 includes an undulating wire 176 and also includes an undulating wire 178 which overlaps the wire 176 at one end and which is bent at the other end to form a portion of the lattice network 172. Line wires 180 and 182 are also included in the lattice network 170, the wire 182 being included at the transition with the network 172.

An undulating wire 184 is disposed partially in the lattice network 172 and is in overlapping relationship with the wire 178. The other end of the wire 184 is bent upwardly to form a part of the lattice network 174. Line wires 186, 188 and 190 extend laterally across the undulating wire 184 in closely spaced relationship to one another. The wire 190 may be disposed at the transition between the lattice networks 172 and 174.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. In combination in a weep screed for providing a reinforcement for stucco at or near the foundation plate line of a building.

a first lattice network disposable against the wall of the building before the addition of stucco to the building and including undulating wires disposed in overlapping relationship for receiving and reinforcing the stucco and including line wires extending across the undulating wires to define overlapping relationships with the undulating wires, and a second lattice network extendable from the wall of the building in transverse relationship to the first lattice network before the addition of stucco to the building and disposed in a horizontal relationship and including undulating wires disposed in overlapping relationship for receiving and reinforcing the stucco and including line wires extending across undulating wires to define overlapping relationships with the undulating wires, and the second lattice network including undulating wires extending into the first lattice network to provide a continuation between the first and second lattice networks.

2. The combination set forth in claim 1 wherein the building includes studs and wherein fasteners extend through the first lattice network into the studs at positions where the overlapping relationships with the undulating wires are produced.

3. The combination set forth in claim 2 wherein the upper portion of the first lattice network is disposed above the foundation plate line and the second lattice network is disposed at a maximum height of the foundation plate line.

4. The combination set forth in claim 1 wherein the second lattice network extends from the first lattice network at an angle different from a perpendicular relationship to the bottom portion of the first lattice network.

5. The combination set forth in claim 4 wherein the first and second lattice networks define a juncture and wherein a bead is disposed at the juncture between the first and second lattice networks.

6. The combination set forth in claim 4 wherein the wires in the first lattice network extend outwardly at an angle near the bottom of the first lattice network relative to the portion of the first lattice network disposable against the wall of the building and the second lattice network extends from the bottom of the fisrt lattice network at an angle different from a perpendicular relationship to the bottom of the first lattice network and at substantially a right angle to the portion of the first lattice network disposable against the wall of the building.

7. The combination set forth in claim 1 wherein the undulating wires in the first and second lattices are joined to each other at the overlapping positions and are joined to the line wires at the positions where the line wires overlap the undulating wires.

8. The combination set forth in claim 7 wherein the building includes studs and wherein fasteners extend through the first lattice network into the studs at positions where the overlapping relationships between the undulating wires and between the undulating wires and the line wires are produced and wherein the upper portion of the first lattice network is disposed above the foundation plate line and the second lattice network is disposed at a maximum height of the foundation plate line.

9. The combination set forth in claim 3 wherein the second lattice network is substantially perpendicular to the first lattice network and a third lattice network is extendable from the second lattice network in transverse relationship to the second lattice network and includes undulating wires disposed in overlapping relationship for receiving and reinforcing the stucco and includes line wires extending across the undulating wires to define overlapping relationships with the undulating wires and a third lattice network includes undulating wires extending to the second lattice network to provide a continuation between the third and second lattice networks and the undulating wires in the second and third lattice networks are joined to each other at the overlapping positions and are joined to the line wires at the positions where the line wires overlap the undulating wires.

10. The combination set forth in claim 4 wherein the line wires in the second lattice network are spaced relatively close together and the line wires in the third lattice network are spaced relatively close together and relatively close to the line wires in the second lattice network.

11. The combination set forth in claim 9 wherein the line wires in the third lattice network are spaced relatively close together.

12. The combination set forth in claim 9 wherein the third lattice network extends upwardly from the second lattice network.

13. In combination in a weep screed for providing a reinforcement for stucco at or near the foundation plate line of a building, first wires disposed in a first lattice arrangement having essentially a vertical disposition and extending at substantially a maximum height of the foundation plate line, second wires disposed in a second lattice arrangement having essentially a horizontal dispostion and disposed at a maximum height of the foundation plate line of the building, and the first and second wires being integrated by third wires disposed in a third lattice arrangement bent through angle from essentially the vertical disposition toward the horizontal disposition.

14. The combination set forth in claim 13 wherein each of the first, second and third wires include at least a first element having an undulating disposition and at least a second element extending laterally across the first element in overlapping relationship with the first element at progressive positions along the second element.

15. In combination in a weep screed for providing a reinforcement for stucco at or near the foundation plate line of a building, first wires disposed in a first lattice arrangement having essentially a vertical disposition, second wires disposed in a second lattice arrangement having essentially a horizontal disposition, and the first and second wires being integrated by third wires disposed in a third lattice arrangement bent through an angle between essentially the vertical disposition and essentially the horizontal disposition, fourth wires disposed in a fourth lattice arrangement having essentially a vertical disposition and displaced horizontally from the first wires, the second and fourth wires being integrated by fifth wires disposed in a fifth lattice arrangement bent through angle between essentially the horizontal disposition and essentially the vertical disposition.

16. The combination set forth in claim 15 wherein the first, second, third, fourth and fifth wires include wires having an undulating disposition and line wires extending in overlapping relationship to such undulating wires and the line wires extending in a particular one of the first, second, third, fourth and fifth wires have a relatively close disposition.

17. The combination set forth in claim 13 wherein the second wires extend at a sharply defined angle different from a perpendicular relationship to the first wires and wherein the first ones of the wires have a relatively close disposition to impart enhanced reinforcement to the stucco.

18. The combination set forth in claim 17 wherein the first wires have a progressively increasing horizontal component near their bottom and the second wires extend in a sharp angle from the first wires at an angle different from a perpendicular relationship to the first wires.

19. The combination set forth in claim 13 wherein the first wires are disposed in overlapping relationship and are attached to one another at their overlapping positions and the second wires are disposed in overlapping relationship and are attached to one another at their intersections and the third wires are disposed in intersecting relationship and are attached to one another at their overlapping positions.

20. The combination set forth in claim 19 wherein the second wires are disposed relatively close together to enhance the reinforcement of the stucco.

21. The combination set forth in claim 19 wherein the first wires include wires having an undulating disposition and line wires extending in overlapping relationship to such undulating wires and the second wires include wires having an undulating disposition and line wires extending in overlapping relationship to such undulating wires and the third wires include wires having an undulating disposition and line wires extending in overlapping relationship to such undulating wires.

22. The combination set forth in claim 19 wherein the building includes studs and wherein fasteners extend into the studs throught the first lattice arrangement at positions where the first wires overlap one another.

23. The combination set forth in claim 19 wherein the building includes studs and wherein fasteners extend into the studs through the first lattice arrangement at positions where the wires included in the first wires and having the undulating relationship overlap the line wires included in the first wires.

24. In combination in a weep screed for providing reinforcement for stucco at or near the foundation plate line of a building, a lattice having first and second sections respectively having predominantly vertical and horizontal dispositions, the first section including:

a plurality of wires having primarily vertical dispositions and disposed in an undulating relationship and having an overlapping relationship near the extremities of the undulations, and line wires extending in a lateral direction in overlapping relationship to the undulating wires at spaced positions to provide a reinforcement for the stucco;

the undulating wires at the bottom of the first section being bent from a predominantly vertical disposition toward a predominantly horizontal disposition to provide a transition between the first and second sections; and the second section including:

line wires extending in the lateral direction in overlapping relationship to the undulating wires in the transition between the first and second sections at the bottom of the first section to provide a reinforcement for the stucco.

25. The combination set forth in claim 24 wherein a plastic bead is disposed at the transition between the first and second sections in attached relationship to the first and second sections.

26. The combination set forth in claim 24 wherein the second section includes wires having a serpentine relationship.

27. The combination set forth in claim 26 wherein the line wires in the second lattice section are disposed below the stucco.

28. The combination set forth in claim 26 wherein the serpentine wires in the second section are disposed relatively close together.

29. The combination set forth in claim 24 wherein the line wires in the second section are disposed relatively close together to impart enhanced reinforcement.

30. The combination set forth in claim 20 wherein the second section is disposed at an angle different from a perpendicular relationship to the bottom of the first section.

31. The combination set forth in claim 30 wherein the bottom of the first section is progressively curved toward the horizontal disposition and wherein the second section is provided with essentially the horizontal disposition.

32. The combination set forth in claim 31 wherein the building includes studs and wherein fasteners extend through the studs into the predominantly vertical components of the first section of the lattice at positions where the undulations overlap near their extremities.

33. The combination set forth in claim 24 wherein the undulating wires extend above the foundation plate line and the undulating wires at the bottom of the first section are disposed at a maximum height of the foundation plate line and the line wires in the second section are disposed at a maximum height of the foundation plate line.

34. The combination set forth in claim 33 wherein the building includes studs and wherein fasteners extend through the studs into the predominantly vertical components of the first section of the lattice at positions where the undulations overlap near their extremities.

* * * * *